US007695589B2

(12) United States Patent
Stark et al.

(10) Patent No.: US 7,695,589 B2
(45) Date of Patent: Apr. 13, 2010

(54) VERSATILE SYSTEM FOR CONDITIONING SLURRY IN CMP PROCESS

(75) Inventors: David A. Stark, Dallas, TX (US); Laurence D. Schultz, Richardson, TX (US); Neal T. Murphy, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 974 days.

(21) Appl. No.: 10/897,286

(22) Filed: Jul. 21, 2004

(65) Prior Publication Data

US 2006/0026906 A1 Feb. 9, 2006

(51) Int. Cl.
*C23F 1/00* (2006.01)
*C09K 3/14* (2006.01)
*H01L 21/306* (2006.01)

(52) U.S. Cl. ..... 156/345.12; 134/50; 134/902; 134/99.1; 156/345.13

(58) Field of Classification Search ..... 156/345.12, 156/345.13, 345.17, 345.18; 134/50, 99.1, 134/902, 990.1; 137/827, 831; 51/307
See application file for complete search history.

(56) References Cited

U.S. PATENT DOCUMENTS 4,168,295 A * 9/1979 Sawyer ..... 422/111
5,100,476 A * 3/1992 Mase et al. ..... 134/1
6,155,706 A * 12/2000 Klein ..... 366/80
6,287,192 B1 * 9/2001 Kim et al. ..... 451/60
6,431,184 B1 * 8/2002 Taniyama ..... 134/1.3
2004/0134514 A1 * 7/2004 Wu et al. ..... 134/1
2006/0026906 A1 * 2/2006 Stark et al. ..... 51/307
2006/0107976 A1 * 5/2006 Boyers et al. ..... 134/94.1

* cited by examiner

*Primary Examiner*—Sylvia R. MacArthur
(74) *Attorney, Agent, or Firm*—Rose Alyssa Keagy; Wade J. Brady, III; Frederick J. Telecky, Jr.

(57) ABSTRACT

The present invention provides a system (100) for conditioning multi-component slurries utilized in chemical mechanical polishing (CMP) of semiconductor wafers (140). The system provides a first slurry component (108), and a second slurry component (120). A conditioning component (102) has first and second inlets, and an outlet operatively coupled to a dispensing system (138). First and second flow control components (116, 126) are operably intercoupled between the first and second inlets and the first and second slurry components, respectively. The system further provides a megasonic energy source (106), adapted to generate an energy field (118) across the conditioning component. A conveyance component (114) conducts the slurry components from the inlets through the energy field, and delivers a final mixture (136) of multi-component slurry to the outlet.

9 Claims, 4 Drawing Sheets

VERSATILE SYSTEM FOR CONDITIONING SLURRY IN CMP PROCESS

TECHNICAL FIELD OF THE INVENTION

The present invention relates generally to the field of semiconductor devices and, more particularly, to apparatus and methods for optimal point-of-use mixing or conditioning of multi-component slurries for chemical-mechanical polishing (CMP).

BACKGROUND OF THE INVENTION

The continual demand for enhanced integrated circuit performance has resulted in, among other things, a dramatic reduction of semiconductor device geometries, and continual efforts to optimize the performance of every substructure within any semiconductor device. A number of improvements and innovations in fabrication processes, material composition, and layout of the active circuit levels of a semiconductor device have resulted in very high-density circuit designs. Increasingly dense circuit design has not only improved a number of performance characteristics, it has also increased the importance of, and attention to, semiconductor material properties and behaviors.

The increased packing density of the integrated circuit generates numerous challenges to the semiconductor manufacturing process. Every device must be smaller without damaging the operating characteristics of the integrated circuit devices. High packing density, low power consumption and good reliability must be maintained without any functional device degradation. Increased packing density of integrated circuits is usually accompanied by smaller feature size.

As integrated circuits become denser, the widths of interconnect layers that connect transistors and other semiconductor devices of the integrated circuit are reduced. As the widths of interconnect layers and semiconductor devices decrease, their resistance increases. As a result, semiconductor manufacturers seek to create smaller and faster devices by using, for example, a copper interconnect instead of a traditional aluminum interconnect. Unfortunately, copper is very difficult to etch in most semiconductor process flows. Therefore, damascene processes have been implemented to form copper interconnects.

Damascene methods usually involve forming a trench and/or an opening in a dielectric layer that lies beneath and on either side of the copper-containing structures. Once the trenches or openings are formed, a blanket layer of the copper-containing material is formed over the entire device. The thickness of such a layer must be at least as thick as the deepest trench or opening. After the trenches or openings are filled with the copper-containing material, the copper-containing material over them is removed, e.g., by chemical-mechanical planarization (CMP), so as to leave the copper containing material in the trenches and openings but not over the dielectric or over the uppermost portion of the trench or opening.

During CMP, slurry is applied to the surface of a wafer as a mechanical polishing pad polishes that surface. Slurries having a variety of chemical and physical compositions are available. Depending upon its composition and its intended use, slurry may be produced to be more copper selective, more dielectric selective, or material neutral. Regardless of their affinity or neutrality, however, slurries generally comprise a number of components, such as abrasives (e.g., alumina) and reactants (e.g., peroxides). At some point in time, these components are mixed together for slurry application to a wafer surface. Ideally, the resulting mixture typically comprises some homogeneous or quasi-homogeneous blend of various particulate matter and chemicals (e.g., suspension, emulsion).

There are generally two approaches to mixing slurry components—premixing and point-of-use mixing. Conventionally, each approach has a number of disadvantages associated therewith. For example, premixed slurries are mixed at a location apart from the CMP apparatus and, for some amount of time, must be stored. Furthermore, depending upon where and when such slurry has been premixed, it may require transport to a site where the CMP apparatus is. Where slurries are left unused while sitting in storage or transport, even for relatively small amounts of time (e.g., 1 hour), a certain degree of degradation begins. Agglomerations of slurry material (e.g., gels) may begin to form. Particulate matter may begin to settle. These and other related phenomena degrade the consistency and efficacy of the slurry over time—resulting in inconsistent CMP results wafer-to-wafer and lot-to-lot. Such deficiencies can cause uneven polishing, scratches or other related anomalies. This, in turn, can cause a number of yield and reliability problems.

Certain conventional systems have attempted to address such issues by monitoring the CMP process to determine when the slurry has degraded past an unacceptable point. Depending upon which conventional system is used, the slurry may then be discarded and replaced, or put through some sort of re-mixing process. Typically, re-mixing is of limited effectiveness, and both approaches introduce a high level of labor and material costs to the manufacturing process.

Conventional point-of-use mixing also causes certain issues for manufacturers. In certain conventional systems, point-of-use mixing is achieved by applying separate slurry components to the wafer while polishing—allowing the polisher (i.e., pad) to mix the components along the surface of the wafer. Utilizing such an approach, a manufacturer cannot be sure that a full and consistent mixing, or an even polish, has occurred.

Other conventional point-of-use mixing systems may rely on an apparatus to briefly mix a small quantity of components immediately prior to application from a single outlet (e.g., nozzle). In many cases, such mixing involves some sort of mechanical agitation (e.g., stirring, shaking) that causes physical impact within or between the components of the slurry. Depending upon the slurry components used, this impact stress can cause component shear—resulting in the formation of additional agglomerations and other non-conformities in the slurry. Furthermore, such mixing is usually brief—not allowing enough time for a full mixing or beneficial pre-reaction of slurry components (i.e., conditioning), depending upon the components used.

These and other similar conventional approaches thus result in a number of CMP irregularities. Agglomerations, gels, settled particulate matter and other non-conformities occurring in such conventional systems could overpolish, under polish, mar or scratch device structures on a wafer surface. If recognized, additional efforts or expenses must be incurred to compensate or allow for these irregularities. If not recognized, these irregularities detrimentally skew the CMP process. Either way, product yield and process costs are negatively impacted.

Moreover, such conventional systems—whether premixed or point-of-use—are typically static in nature, providing for only a single slurry formulation during CMP. Most conventional systems provide the ability to change slurry formulation only on a lot-to-lot basis. Depending upon the system utilized, a manufacturer might be able to change slurry formulation on a wafer-to-wafer basis. Given the methods and apparatus of most conventional systems, however, wafer-to-wafer modification would be an exceptional circumstance rather than a routine operation—as it would add a number of time and labor-intensive steps to the process (e.g., stopping processing lines, purging component reservoirs and conduits, refilling). For similar reasons, intra-wafer modification of slurry formulation would be commercially impractical, if not impossible.

As a result, there is a need for a versatile system for point-of-use mixing or conditioning of multi-component slurries used in CMP—a system that fully and completely mixes slurry components in a versatile, non-stressful manner that reduces or eliminates slurry nonconformities, and provides for real-time modification of slurry composition, in an easy, efficient and cost-effective manner.

SUMMARY OF THE INVENTION

The present invention provides a versatile system, comprising a number of apparatus and methods, for point-of-use mixing or conditioning of multi-component slurries used in CMP. Comprehending certain complications arising from conventional premix and point-of-use approaches, the system of the present invention provides optimal slurry mixing or conditioning by non-stressful agitation or activation of slurry components or slurry. The system of the present invention significantly reduces or eliminates slurry nonconformities, providing consistent and reliable CMP results. The present invention further eliminates the need for labor intensive monitoring and adjustment of slurry composition, as certain embodiments of the present invention provide for automated control or real-time adjustment of slurry composition. By the present invention, CMP results may be fine-tuned on a wafer-to-wafer, or even intra-wafer, basis. The present invention thus provides optimal slurry composition in an easy, efficient and cost-effective manner.

Specifically, the present invention provides a conditioning component that may be formed as part of a CMP apparatus, or added on to an already existing CMP apparatus. One or more slurry mixtures or components are introduced into the conditioning component, concurrently or sequentially. The slurry mixture is conducted through one or more conduits or chambers, where it is subjected to intense, non-damaging energy. This infusion of energy disperses matter evenly throughout the mixture, separates any agglomerations of material in the mixture, and promotes activation or pre-reaction of materials in the mixture. The conditioning component dispenses the uniform, highly serviceable slurry mixture for immediate polishing use.

More specifically, one embodiment of the present invention provides a system for conditioning multi-component slurries utilized in chemical mechanical polishing (CMP) of semiconductor wafers. The system provides supplies of a first slurry component and a second slurry component. A conditioning component has first and second inlets, and an outlet operatively coupled to a dispensing system. First and second flow control components are operably intercoupled between the first and second inlets and the first and second slurry components supplies, respectively. A megasonic energy source is adapted to generate an energy field across the conditioning component. A conveyance component within the conditioning component conducts the slurry components from the inlets through the energy field, and delivers a final mixture of multi-component slurry to the outlet.

Another embodiment of the present invention provides a method of conditioning slurry, immediately prior to chemical mechanical polish. A conveyance component is disposed in immediate proximity to a polishing apparatus. A slurry component is introduced into the conveyance component via an inlet. An energy source is adapted to generate an energy field across the conveyance component. The slurry component is passed through the conveyance component and energy field, and a final slurry mixture is dispensed from the conveyance component to the polishing apparatus, via an outlet.

The present invention further provides a system for providing immediate mix adjustment in multi-component slurry for chemical mechanical polishing. The system provides first and second slurry component supplies. A conditioning component has first and second inlets and an outlet. First and second selectively adjustable flow control components are operably intercoupled between the first and second inlets and the first and second slurry component supplies, respectively. A selectively adjustable megasonic energy source is adapted to generate a megasonic energy field across the conditioning component. Mixing of the first and second slurry components is altered, in a required or desired manner, by adjusting either the megasonic energy source or the first or second flow control components.

Other features and advantages of the present invention will be apparent to those of ordinary skill in the art upon reference to the following detailed description taken in conjunction with the accompanying drawings.

BRIEF DESCRIPTION OF THE DRAWINGS

For a better understanding of the invention, and to show by way of example how the same may be carried into effect, reference is now made to the detailed description of the invention along with the accompanying figures in which corresponding numerals in the different figures refer to corresponding parts and in which.

DETAILED DESCRIPTION OF THE INVENTION

Figure 1:
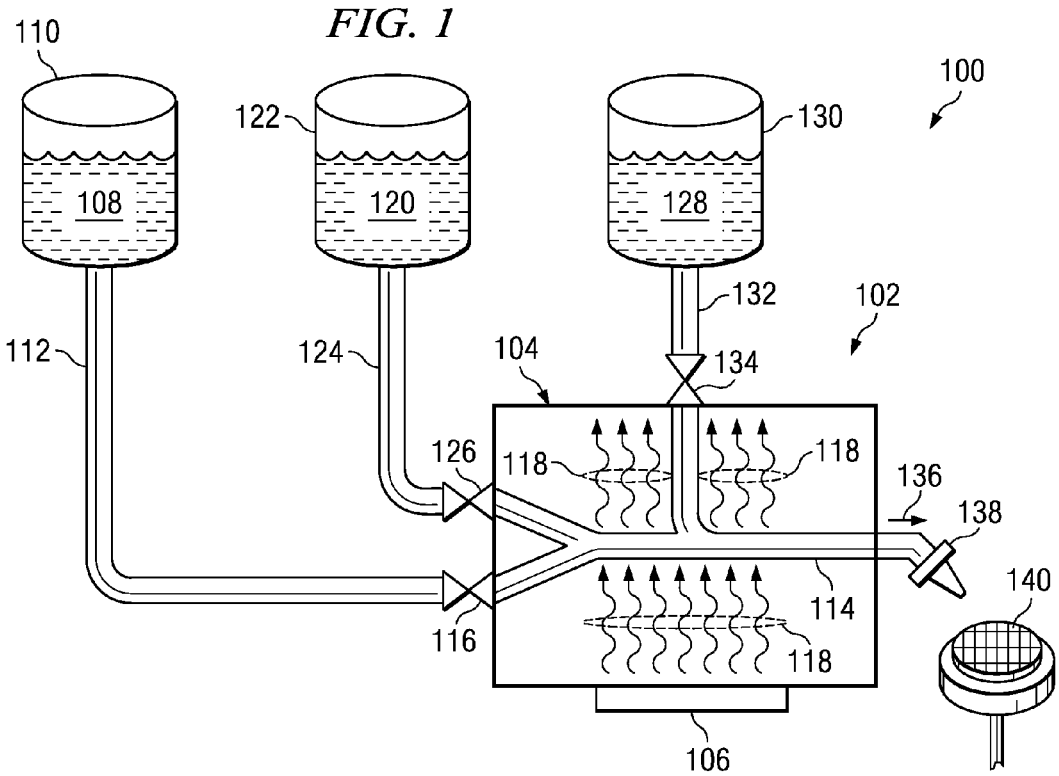
FIG. 1 provides an illustration depicting one embodiment of a conditioning system according to the present invention.

While the making and using of various embodiments of the present invention are discussed in detail below, it should be appreciated that the present invention provides many applicable inventive concepts, which can be embodied in a wide variety of specific contexts. The present invention is hereafter illustratively described in conjunction with the mixing and conditioning of polishing slurries and slurry components, for use in chemical mechanical polishing systems. The specific embodiments discussed herein are, however, merely demonstrative of specific ways to make and use the invention and do not limit the scope of the invention.

The present invention provides a versatile system, comprising a number of apparatus and methods, for point-of-use mixing or conditioning of multi-component slurries used in CMP. The system of the present invention may also be utilized to remix or recondition premixed slurries that have been stored for some time.

Comprehending certain complications arising from conventional premix systems, the present invention provides a versatile point-of-use system that eliminates the need to store slurry mixtures. Comprehending certain complications arising from conventional point-of-use system, the system of the present invention mixes and conditions slurry materials utilizing intense, non-damaging energy to activate and evenly disperse slurry components. The system of the present invention may be formed or adjusted to condition or mix slurry material for a desired amount of time, providing for beneficial pre-reaction of slurry components. Embodiments of the present invention provide for dynamic alteration of slurry composition or mixture, providing "on-the-fly" CMP adjustment capabilities.

The system of the present invention significantly reduces or eliminates slurry nonconformities, providing consistent and reliable CMP results. The present invention further provides a level of CMP control not associated with conventional systems, while eliminating needs for labor intensive monitoring and adjustment of slurry composition. By the present invention, CMP results may be fine-tuned on a wafer-to-wafer, or even intra-wafer, basis. The present invention thus provides consistently high-quality, uniform slurry mixture(s), optimizing CMP process stability and repeatability.

Specifically, the present invention provides a conditioning component that may be formed as part of a CMP apparatus, or added on to an already existing CMP apparatus. For ease of reference, mixing and other desired manipulations of slurry components (e.g., circulating, energizing) are hereinafter collectively referred to as conditioning, unless otherwise specifically noted. The conditioning component of the present invention may comprise one or more sub-components or systems formed or assembled in accordance herewith. One or more slurry mixtures or components are introduced, from supply lines or supply reservoirs, into the conditioning component, concurrently or sequentially. Certain embodiments of the present invention may comprise various fixed or dynamic flow control mechanisms to adjust or halt the introduction of any desired slurry component. The slurry mixture is conducted through one or more conduits or chambers. Depending upon the specific composition of slurry, or upon the reactive nature of its component(s), the conduits or chambers may be formed or configured to foster circulation of, or induce turbulence into, slurry flowing through. As the slurry mixture passes into, through, or out of the conduits or chambers, it is subjected to intense, non-damaging energy from one or more sources. The infused energy causes uniform dispersion of slurry components throughout the mixture, and increases the kinetic energy of those components. Undesired agglomerations of material are separated, and activation or pre-reaction of slurry materials is promoted. From the conditioning component, a uniform, highly serviceable slurry mixture is dispensed for immediate polishing use.

Certain aspects of the present invention are described in greater detail now with reference to slurry conditioning system 100, as depicted in FIG. 1. System 100 comprises a conditioning component 102. Component 102 comprises an energy transmission component 104 and an energy source 106. Component 102 is disposed in immediate proximity to a polishing apparatus—formed as part of or attached to a polishing apparatus, or located immediately adjacent thereto. An initial slurry material 108 is introduced to component 102 from reservoir 110 via supply line 112. Line 112 introduces material 108 to a conveyance component 114 disposed within transmission component 104. A flow control component 116 (e.g., a valve) may be disposed between supply line 112 and conveyance 114, to provide manual or automated control of the rate or amount of material 108 introduced.

Conveyance 114 conducts material 108 through component 104, where it is subjected to one or more energy fields 118. Fields 118 comprise a flow of intense, non-damaging energy (e.g., megasonic energy) directed at and through materials contained by conveyance 114. Fields 118 are generated or sourced by source 106, which is conductively coupled to transmission component 104. Component 104 comprises a material, medium, or combination of elements provided to transmit a significant portion, if not all, of the energy generated by source 106 across or throughout component 104—forming field(s) 118. The relative configuration of source 106 and conveyance 114, or the composition of component 104, or combinations thereof, may be varied to produce fields 118 of varying magnitude or direction with respect to material(s) contained by conveyance 114. As material(s) in conveyance 114 pass or are passed through field 118, those materials are conditioned in a desired manner. This conditioning may include, but is not limited to: dispersion of settled particulate matter, separation of agglomerations, creation of mixing flows or currents, induction of material reactions, or energizing (e.g., heating) of matter within the material(s).

Additional initial slurry material(s) 120 may be introduced to component 114 from reservoir 122 via supply line 124, concurrent with material 108. Again, a flow control component 126 (e.g., a valve) may be disposed between supply line 124 and conveyance 114, to provide manual or automated control of the rate or amount of material 120 introduced. One or more secondary slurry material(s) 128 may be introduced to component 114, downstream of material 108, from reservoir 130 via supply line 132. A flow control component 134 (e.g., a valve) may be disposed between supply line 132 and conveyance 114, to provide manual or automated control of the rate or amount of material 128 introduced. In addition to, or in place of, flow control components, the slurry components may be introduced from pressurized supply lines—providing a further flow rate adjustment for conveyance 114. Conveyance 114 transfers a final slurry mixture 136 from component 102 to a dispensing mechanism or system 138 (e.g., nozzle apparatus)—ready for immediate use in polishing a semiconductor wafer 140.

In such a manner, any number of slurry materials or components may be mixed together or conditioned with precision. Component conditioning times and ratios may be selectively adjusted, using either automated or manual systems, to optimize the composition and state of a slurry mixture 136 dispensed from component 102.

A wide variety of materials and configurations may be provided as component 102 according to the present invention. Energy transmission component 104 may comprise solid matter, liquid matter, or a combination of the both, as long as it sufficiently transmits energy from source 106. In certain embodiments, for example, component 104 may comprise a solid block of non-reactive material (e.g., steel, ceramic, plastic) through which an aperture or channel is formed as conveyance 114. Such embodiments may have an energy source 106 comprising one or more flat megasonic transducers disposed along an external surface of component 104—operating, for example, somewhere in between about 1M cycles/second and about 2M cycles/second. In other embodiments, component 104 may comprise a pipe or similar conduit, formed of a suitable material and having a desired length and shape, in accordance with the present invention. In such embodiments, energy source 106 may comprise one or more megasonic transducers wrapped or folded along an exterior surface of the conduit. Alternatively, source 106 may comprise cylindrical, core-type megasonic transducer provided centrally within the conduit, such that slurry component flow around the transducer. In still other embodiments, several transmission media or elements may be combined. For example, certain embodiments may provide component 104 as a solid housing within which a volume of liquid (e.g., water) is stored. Conveyance 114 may be provided as a conduit routed through the liquid such that all outer surfaces of the conduit are bathed in and surrounded by the liquid. A number of megasonic transducers may be disposed along one or more surfaces of the solid housing to create desired energy fields within the liquid, which then surround the conduit and slurry flowing therein.

Although heretofore presented as a megasonic transducer, energy source 106 may comprise any suitable energy source that is capable of supplying intense, non-shearing energy at a rate and volume sufficient to manifest the desired slurry mixing and conditioning responses. Furthermore, source 106 may comprise a sonic transducer operating somewhere at or below megasonic levels (e.g., ≦~700 K cycles/sec). Depending upon the composition or desired reaction of the slurry components, source 106 may comprise something other than a sonic energy source. For example, in certain embodiments, source 106 may comprise a high-intensity UV light or laser, and component 104 may comprise a lense, amplification or filtering material. Other embodiments, where desirable and feasible, may comprise more exotic sources such as electromagnetic or quantum particle sources. All such alternatives or variations are comprehended hereby. Depending upon the embodiment, source 106 may be adjustable, in position or operation—providing real-time adjustment of, or selective strength and direction to, field 118. In certain embodiments, for example, it may be desirable to provide manual or automated adjustment of the cycle rate of a sonic transducer in order to effect varying degrees of particulate dispersion. In other embodiments, for example, alternating members of a transducer array may be cycled on and off to facilitate a particular mixing current or turbulence within conveyance 114. Other similar variations or combinations may be provided in accordance with the present invention.

Slurry materials 108, 120 and 128 comprise any desired chemical, compound or substance for which conditioning in accordance with the present invention is desired. In certain embodiments, for example, material 108 may comprised a pre-mixed slurry that needs reconditioning in order to disperse particulate matter already present therein before dispensing. In certain variations thereof, no other slurry components 120 or 128 are added, and slurry 136 is identical in composition to material 108. In other variations thereof, additional components 120 or 128 (e.g., $H_2O$, $H_2O_2$, HF, alumina) may be added concurrently or sequentially, respectively, to dilute, strengthen or otherwise modify the properties of material 108. In other embodiments, material 108 comprises an individual slurry component to which other components 120 or 128 (e.g., $H_2O$, $H_2O_2$, HF, alumina) are added concurrently or sequentially, respectively, to render a slurry mixture 136.

Reservoirs 110, 122 and 130 comprise any suitable container or storage facility within which desired slurry components or mixtures are or may be held. Each reservoir may comprise a structure or component that is collocated with, adjacent to, or remote from component 102 and the polishing apparatus. Drums, bins, barrels, trough, pressurized cylinders, hoppers and other suitable containers may be employed in accordance with the present invention. Supply lines 112, 124 and 132 comprise suitable conduits or conductors to move the slurry components from the reservoirs. Pressurized lines, hoses, pipes, ramps, tubes, troughs, channels and other suitable conveyances may be employed in accordance with the present invention. Flow control components 116, 126 and 134 comprise any suitable structures (e.g., spigots, solenoids, irises, gates) providing manual or automatic selective control of the introduction or rate of introduction of desired slurry components into conveyance 114. Any number of initial or secondary slurry components may thus be coupled to system 100 in anticipation of use in slurry mixing, without waste. Each component may be maintained in an isolated environment, under varying storage conditions, until only a very precise amount is required to produce mixture 136. Manually or automatically manipulating the flow control components, the composition of mixture 136 may be changed on an immediate basis. The present invention thus provides for real-time adjustments in slurry composition.

Figure 2:
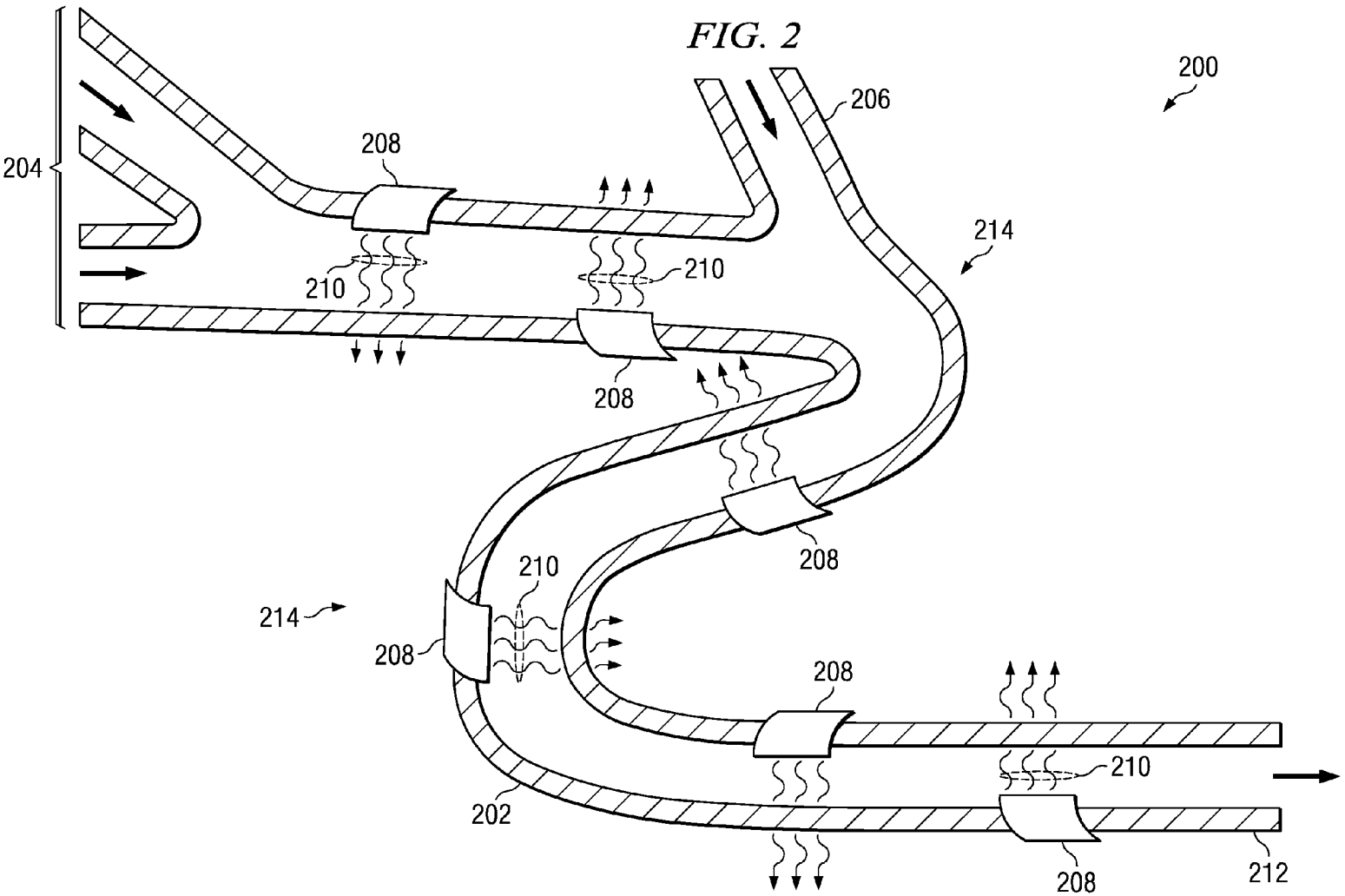
FIG. 2 provides an illustration depicting one embodiment of a conditioning component according the present invention.
Figure 3:
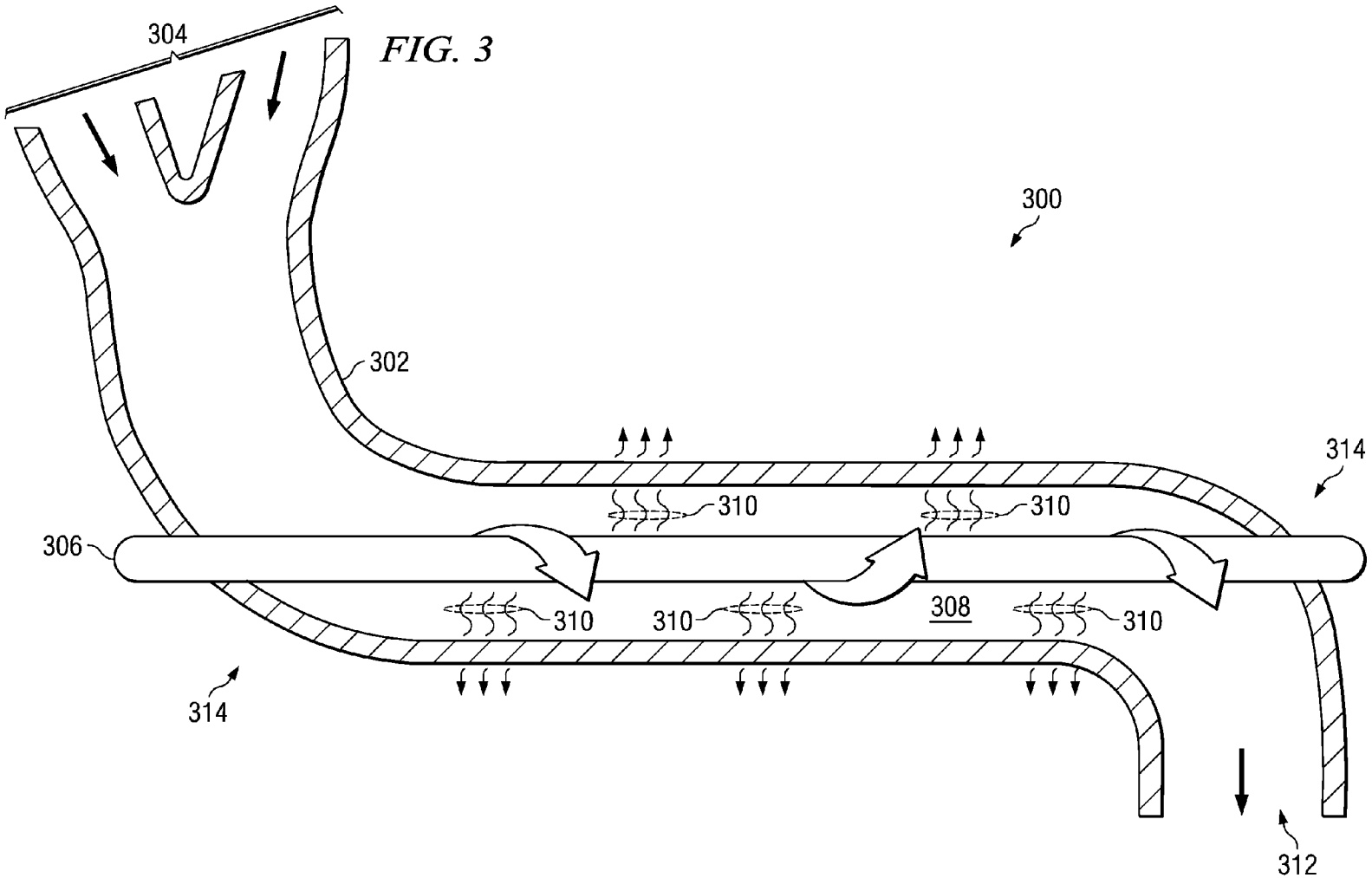
FIG. 3 provides an illustration depicting another embodiment of a conditioning component according the present invention.
Figure 4:
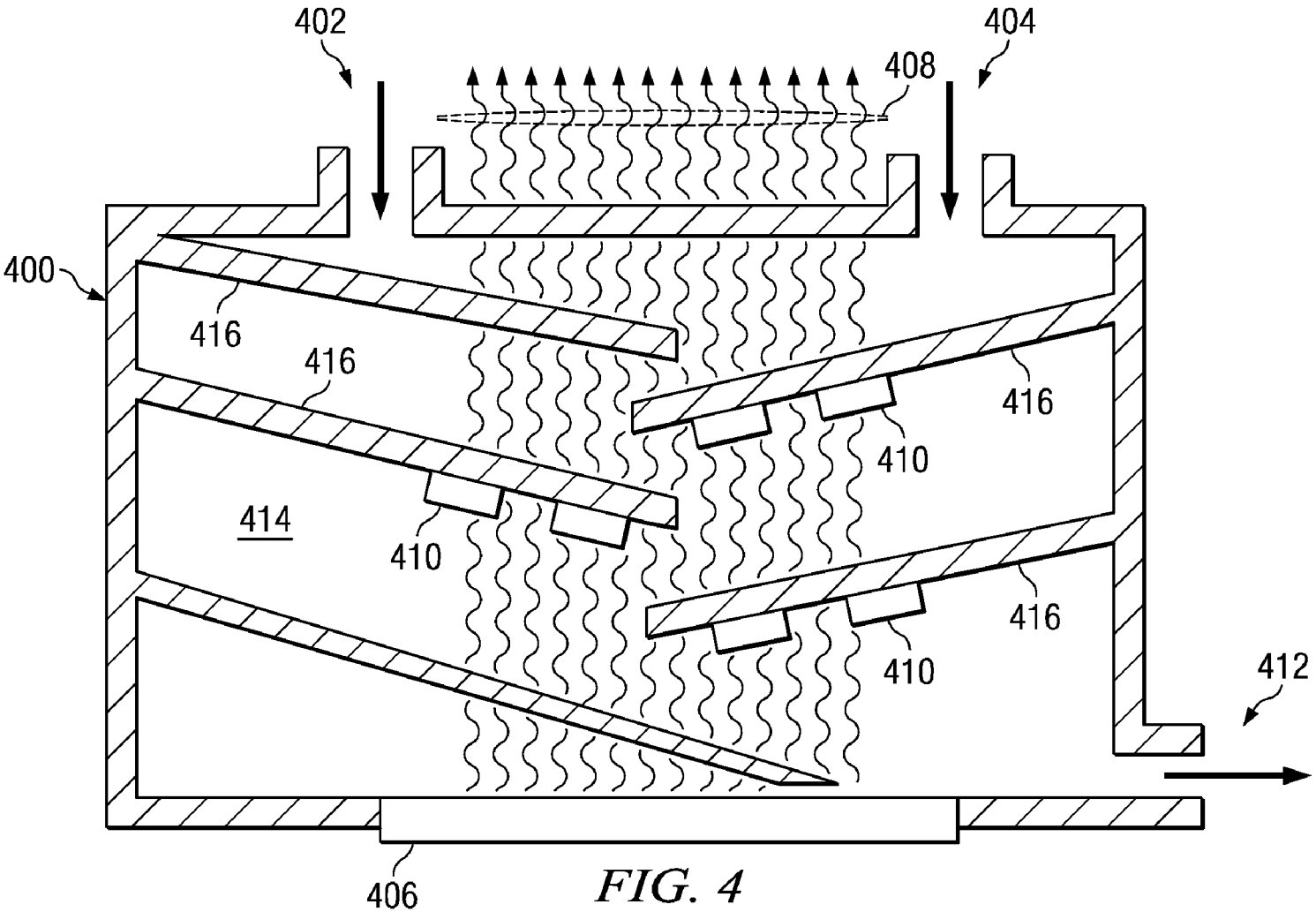
FIG. 4 provides an illustration depicting another embodiment of a conditioning component according the present invention.

Several illustrative embodiments of a conditioning component in accordance with the present invention are depicted now with reference to FIGS. 2-4. As illustrated with reference now to FIG. 2, a conditioning component 200 comprises a conveyance conduit 202 having one or more initial inlets 204, through which initial slurry components are introduced. Component 200 may, if required or desired, further comprise one or more secondary inlets 206, through which secondary slurry components may be sequentially introduced, disposed along conduit 202. In this embodiment, component 200 comprises one or more megasonic transducers 208, disposed along the outer surface of conduit 202, and configured in such a manner that they output sonic energy into and through conduit 202, generating energy fields 210 through which slurry components pass and are conditioned by. In alternative embodiments, transducer(s) 208 may be embedded within the wall(s) of conduit 202, or disposed along the inner surface thereof, depending upon the structural or operational characteristics of the transducers, the conduit, or the slurry components. Component 200 has one or more outlets 212 from which conditioned slurry is transferred to a dispensing apparatus or system.

Conduit 202 is formed of a material suitable for the desired slurry components or mixtures (e.g., steel, ceramic, plastic). Conduit 202 may comprise a tube, duct or other similar structure having a desired cross-sectional profile or shape (e.g., circular, rectangular, polygonal). The cross-section profile of conduit 202 may be selected or formed to promote or cause certain behaviors (e.g., circulation, turbulence) in the slurry components or mixtures as they flow therethrough, and the cross-sectional profile or shape may be varied or alternated at different points along the conduit. Conduit 202 may be provided with one or more deviations 214 (e.g., bends, turns, spirals) along its path, to promote or cause certain behaviors (e.g., circulation, turbulence) in the slurry components or mixtures, or to facilitate introduction of secondary slurry components.

Referring now to FIG. 3, another embodiment of a conditioning component 300 comprises a conveyance conduit 302 having one or more initial inlets 304, through which initial slurry components are introduced. Component 300 may, if required or desired, further comprise one or more secondary inlets (not shown), through which secondary slurry components may be sequentially introduced. In this embodiment, component 300 comprises a megasonic energy source 306. Source 306 is disposed such that it is positioned within an open inner area 308 along conduit 302. In this embodiment, source 306 is centered within area 308 such that as slurry components flow into and through area 308, they surround source 306. Source 306 is adapted or formed to output sonic energy radially, from the middle of area 308 outward. Source 306 may be adapted or formed to produce a contiguous energy field throughout area 308, or may produce intermittent or alternating energy fields 310 in desired portions or patterns throughout area 308. Slurry components pass through the energy field(s) and, depending upon the configuration of component 300, are mixed or conditioned thereby. Component 300 has one or more outlets 312 from which conditioned slurry is transferred to a dispensing apparatus or system.

Conduit 302 is formed of a material suitable for the desired slurry components or mixtures (e.g., steel, ceramic, plastic). Conduit 302 may comprise a tube, duct or other similar structure having a desired cross-sectional profile or shape (e.g., circular, rectangular, polygonal). The cross-section profile of conduit 302 may be selected or formed to promote or cause certain behaviors (e.g., circulation, turbulence) in the slurry components or mixtures as they flow therethrough, and the cross-sectional profile or shape may be varied or alternated at different points along the conduit. Conduit 302 may be provided with one or more deviations 314 (e.g., bends, turns, spirals) along its path, to promote or cause certain behaviors (e.g., circulation, turbulence) in the slurry components or mixtures, to facilitate introduction of secondary slurry components, or to facilitate the placement or operation of source 306.

Another embodiment of a conditioning component 400 is illustrated with reference now to FIG. 4. Component 400 comprises a conveyance unit assembled or formed in accordance with the present invention. Unit 400 may be formed by machining, injection molding, foundry, assembly or other similar methods of fabrication; and is formed of material suitable for the desired slurry components or mixtures (e.g., steel, ceramic, plastic) and conditioning. In this embodiment, unit 400 is depicted as a manifold-type assembly. Unit 400 comprises one or more initial inlets 402, through which initial slurry components are introduced. Component 400 may, if required or desired, further comprise one or more secondary inlets 404, through which secondary slurry components may be sequentially introduced, disposed along the upper or side walls of unit 400.

In this embodiment, component 400 comprises a foundational energy source 406, disposed along the lower outer surface of conduit unit 400. Source 406 comprises a megasonic transducer, and is configured in such a manner that it outputs sonic energy upwardly through unit 400. This generates energy field 408, through which slurry components pass and are conditioned by. In alternative embodiments, source 406 may be embedded within the lower wall of unit 400, or disposed along the lower inner surface thereof, depending upon the structural or operational characteristics of the transducer, the manifold, or the slurry components. In other alternative embodiments, unit 400 may comprise additional energy sources 410, disposed along or within other portions of unit 400. Component 400 has one or more outlets 412 from which conditioned slurry is transferred to a dispensing apparatus or system.

Component 400 comprises a central chamber 414, into which one or more fins or platforms 416 extend from the external walls of unit 400. The number, placement, size and configuration of platforms 416 may be selected or provided to promote or cause certain behaviors (e.g., circulation, turbulence) in the slurry components or mixtures as they flow through chamber 414, or to facilitate introduction of secondary slurry components. The number, placement, size and configuration of platforms 416 may also be varied or alternated at different points along throughout chamber 414.

Other variations and combinations of conditioning components may be provided in accordance with the present invention, as well. For example, conduit 202 may be housed in a chamber, surrounded by a liquid (e.g., water). Energy sources in addition to, or instead of, sources 208 may be provided along the outer wall of such a chamber, transmitting an energy field throughout the liquid to surround conduit 202. In other variations, segmented or separated energy sources may be cycled in alternating, intermittent or random patterns to produce a desired conditioning effect. Energy sources of different types (e.g., sonic and UV) may be provided concurrently to produce a desired conditioning effect. These and other alternatives are comprehended hereby.

Thus, utilizing the structures and methods of the present invention, slurry components are mixed or conditioned in a precise manner, providing uniform and repeatable slurry conditioning. The versatile structures of the present invention are readily adaptable to a number of configurations, easily providing a selectable range of conditioning results. For example, the length of a conduit in a conditioning component may be selected or formed to provide a desired conditioning time, based on a given flow rate of slurry components. Similarly, the number or configuration of turns, spirals, platforms or other deviations within a conveyance component may be determined and provided to effect a desired slurry condition. Decomposition or degradation of certain slurry components can be minimized or eliminated by introducing them later in the conditioning process, via a secondary inlet. Gentle mixing of initial slurry components near inlet structures may be provided in conjunction with very intense conditioning immediately prior an outlet structure. Separate or partially separated conveyance paths for different components may be provided to provide differentiated conditioning within a single system. In all embodiments, a desired or required level of component mixing, activation or conditioning is provided on a consistent basis, and naturally occurring or stress-based anomalies are significantly reduced or eliminated.

The embodiments and examples set forth herein are thus presented to best explain the present invention and its practical application, and to thereby enable those skilled in the art to make and utilize the invention. However, those skilled in the art will recognize that the foregoing description and examples have been presented for the purpose of illustration and example only. The description as set forth is not intended to be exhaustive or to limit the invention to the precise form disclosed. As stated throughout, many modifications and variations are possible in light of the above teaching without departing from the spirit and scope of the following claims.

What is claimed is:

1. A CMP slurry mixing system comprising:

a first CMP slurry component supply;

a second CMP slurry component supply;

a conditioning component, having first and second inlets and an outlet;

first and second flow control components, operably intercoupled between the first and second inlets and the first and second CMP slurry component supplies, respectively; and an energy source adapted to generate an enemy field across the conditioning component during chemical mechanical polishing;

wherein the conditioning component comprises a conveyance component, operatively coupled to the first and second inlets and to the outlet; and further wherein the conditioning component comprises an energy transmission component interposed between the conveyance component and the energy source.

2. A CMP slurry mixing system comprising:

a first CMP slurry component supply;

a second CMP slurry component supply;

a conditioning component, having first and second inlets and an outlet;

first and second flow control components, operably intercoupled between the first and second inlets and the first and second CMP slurry component supplies, respectively; and an energy source adapted to generate an enemy field across the conditioning component during chemical mechanical polishing;

wherein the conditioning component comprises a conveyance component, operatively coupled to the first and second inlets and to the outlet; and further wherein the conveyance component comprises a conduit.

3. A CMP slurry mixing system comprising:

a first CMP slurry component supply;

a second CMP slurry component supply;

a conditioning component, having first and second inlets and an outlet;

first and second flow control components, operably intercoupled between the first and second inlets and the first and second CMP slurry component supplies, respectively; and an energy source adapted to generate an energy field across the conditioning component during chemical mechanical polishing;

wherein the energy source comprises a sonic energy source.

4. A CMP slurry mixing system comprising:

a first CMP slurry component supply;

a second CMP slurry component supply;

a conditioning component, having first and second inlets and an outlet;

first and second flow control components, operably intercoupled between the first and second inlets and the first and second CMP slurry component supplies, respectively; and an energy source adapted to generate an enemy field across the conditioning component during chemical mechanical polishing;

wherein the energy source comprises a megasonic transducer.

5. The system of claim 4, wherein the megasonic transducer is operable between about 700K cycles/second and about 2M cycles/second.

6. A CMP slurry mixing system comprising:

a first CMP slurry component supply;

a second CMP slurry component supply;

a conditioning component, having first and second inlets and an outlet;

first and second flow control components, operably intercoupled between the first and second inlets and the first and second CMP slurry component supplies, respectively; and an energy source adapted to generate an enemy field across the conditioning component during chemical mechanical polishing;

wherein the conditioning component comprises a conveyance component, operatively coupled to the first and second inlets and to the outlet; and further wherein the conveyance component comprises one or more deviations.

7. A CMP slurry mixing system comprising:

a first CMP slurry component supply;

a second CMP slurry component supply;

a conditioning component, having first and second inlets and an outlet;

first and second flow control components, operably intercoupled between the first and second inlets and the first and second CMP slurry component supplies, respectively; and an energy source adapted to generate an enemy field across the conditioning component during chemical mechanical polishing;

wherein the first and second flow control components are manually operable.

8. A CMP slurry mixing system comprising:

a first CMP slurry component supply;

a second CMP slurry component supply;

a conditioning component, having first and second inlets and an outlet;

first and second flow control components, operably intercoupled between the first and second inlets and the first and second CMP slurry component supplies, respectively; and an energy source adapted to generate an energy field across the conditioning component during chemical mechanical polishing;

wherein the first and second flow control components are automated.

9. A system for providing immediate mix adjustment in multi-component slurry for chemical mechanical polishing, the system comprising:

first and second CMP slurry component supplies;

a conditioning component, having first and second inlets and an outlet;

first and second selectively adjustable flow control components, operably intercoupled between the first and second inlets and the first and second CMP slurry component supplies, respectively; and a selectively adjustable megasonic energy source, adapted to generate a megasonic energy field across the conditioning component;

wherein either the megasonic energy source or the first or second flow control components are adjusted to alter mixing of the first and second CMP slurry component supplies during the chemical mechanical polishing.

* * * * *